US009319811B2

(12) United States Patent
Etwil et al.

(10) Patent No.: US 9,319,811 B2
(45) Date of Patent: Apr. 19, 2016

(54) HEARING DEVICE WITH CLOSURE MECHANISM

(71) Applicant: GN ReSound A/S, Ballerup (DK)

(72) Inventors: Alex Etwil, Albertslund (DK); Finn Hansen, Smorum (DK); Michael Frydendahl, Sjaelland (DK)

(73) Assignee: GN RESOUND A/S, Ballerup (DK)

( * ) Notice: Subject to any disclaimer, the term of this patent is extended or adjusted under 35 U.S.C. 154(b) by 24 days.

(21) Appl. No.: 14/199,243

(22) Filed: Mar. 6, 2014

(65) Prior Publication Data

US 2015/0249895 A1 Sep. 3, 2015

(30) Foreign Application Priority Data

Mar. 3, 2014 (DK) ..... 2014 70100
Mar. 3, 2014 (EP) ..... 14157440

(51) Int. Cl.
*H04R 25/00* (2006.01)
*H04R 1/10* (2006.01)

(52) U.S. Cl.
CPC . *H04R 25/65* (2013.01); *H04R 1/10* (2013.01)

(58) Field of Classification Search
CPC ..... H04R 25/65; H04R 1/10
USPC ..... 381/312, 323
See application file for complete search history.

(56) References Cited

U.S. PATENT DOCUMENTS

| | | | | |
|---|---|---|---|---|
| 6,088,465 | A * | 7/2000 | Hanright | H04R 25/556 381/322 |
| 6,985,598 | B1 * | 1/2006 | Joschika | 381/323 |
| 8,477,977 | B2 * | 7/2013 | Aquilina | 381/312 |
| 2009/0110222 | A1 * | 4/2009 | Heerlein | H04R 25/602 381/323 |
| 2010/0172528 | A1 | 7/2010 | Fickweiler et al. | |
| 2011/0261984 | A1 * | 10/2011 | Reber | 381/323 |
| 2013/0266167 | A1 * | 10/2013 | Karamuk et al. | 381/322 |
| 2014/0177893 | A1 * | 6/2014 | Lu et al. | 381/323 |

FOREIGN PATENT DOCUMENTS

| | | | |
|---|---|---|---|
| DE | 10 2009 004 118 | B3 | 7/2010 |
| DE | 102010041263 | A1 | 3/2012 |
| EP | 2 229 008 | A1 | 9/2010 |
| EP | 2 528 138 | A1 | 11/2012 |

OTHER PUBLICATIONS

Extended European Search Report dated Aug. 18, 2014, for related EP Patent Application No. 14157440.0, 7 pages.
First Technical Examination and Search Report dated Sep. 25, 2014, for related DK Patent Application No. PA 2014 70100, 4 pages.

* cited by examiner

*Primary Examiner* — Tuan D Nguyen
(74) *Attorney, Agent, or Firm* — Vista IP Law Group, LLP

(57) ABSTRACT

A closure member and a hearing device are disclosed. The hearing device comprising a housing; a battery door attached to the housing and configured to pivot in relation to the housing about a pivot axis; closure member attached to the housing and having a first closure arm with a first distal end; the battery door comprising a closure device comprising a first primary closure element configured to engage with the first closure arm when the battery door is in a closed position, wherein the first closure arm is flexible such that the first distal end displaces in a first direction when the battery door is moved from an open position to the closed position.

17 Claims, 12 Drawing Sheets

HEARING DEVICE WITH CLOSURE MECHANISM

RELATED APPLICATION DATA

This application claims priority to and the benefit of Danish Patent Application No. PA 2014 70100 filed on Mar. 3, 2014, pending, and European Patent Application No. 14157440.0 filed on Mar. 3, 2014, pending. The entire disclosures of both of the above applications are expressly incorporated by reference herein.

FIELD

The present disclosure relates to a hearing device with a closure mechanism, and in particular to a hearing device with a battery door for accommodating and/or supporting a battery in the hearing device.

BACKGROUND

A focus in the hearing aid industry is to make hearing aids smaller and more discrete for the benefit of the user and thus a design which can decrease the size of the hearing aid is of importance. Further, it is of great interest from a cost perspective that designs are easy and cheap to manufacture. Generally a button battery is used in a hearing device and traditionally a battery door of a hearing aid has been fitted with a locking mechanism leading to bulky hearing devices, a complex manufacturing process and/or high failure rate of the locking mechanism.

Further, hearing device parts must be robust and resistant to wear. Further, precise fitting of moving parts is desired for improving the user experience.

SUMMARY

There is a need for an improved closure mechanism suitable for a hearing device.

Disclosed is a hearing device comprising a housing; a battery door attached to the housing and configured to pivot in relation to the housing about a pivot axis; and a closure member attached to the housing and having a first closure arm with a first distal end. The battery door comprises a closure device comprising a first primary closure element configured to engage with the first closure arm when the battery door is in a closed position. The first closure arm is flexible such that the first distal end displaces in a first direction when the battery door is moved from an open position to the closed position. The displacement of the first distal end has a primary directional component parallel to the pivot axis.

Also disclosed is a closure member for a hearing device. The closure member comprises a closure body and a first closure arm. The closure body and the first closure arm forms an angle in the range from 90 to 170 degrees.

Descriptions of features relating to the closure member are equally applicable to the closure member of the disclosed hearing device, and vice versa. Consequently, throughout the description reference to "the closure member" is a reference to both the closure member and the closure member of the hearing device.

The disclosed hearing device and closure member provide a durable and sustainable closure mechanism for a battery door of a hearing device. Furthermore, a separable closure member allows the closure member and the hearing device housing to be manufactured as two independent parts, providing a high degree of design freedom, e.g. with relation to materials.

The possibility of manufacturing the closure member independently from the hearing device housing and the battery door offers several benefits.

The closure member may easily be manufactured in a material different from the hearing device housing. It is desired, within the technical field, to manufacture different parts by materials having mechanical properties matching the mechanical requirements of the specific part. For example, the closure member is subject to mechanical wear and requires flexibility which is quite different from requirements of the housing.

A closure member independent from the housing provides an increased design freedom.

Furthermore, the disclosed hearing device and closure member provides the closure member as an exchangeable part which may be exchanged if needed, especially beneficial for parts, such as the closure member, which are subject to mechanical wear and tear.

As a further advantage, the disclosed hearing device and closure member facilitates a small battery door, and limited requirements for tolerances of parts.

As an even further advantage, the closure mechanism provides reduced wear on the battery hinge arrangement, e.g. the primary directional component of the displacement of the first and or a second closure arm being parallel to the pivot axis reduces wear on the battery door hinge arrangement and closure arrangement.

A hearing device includes: a housing; a battery door attached to the housing to pivot in relation to the housing about a pivot axis; and a closure member attached to the housing and having a first closure arm with a first distal end; wherein the battery door comprises a closure device having a first primary closure element configured to engage with the first closure arm when the battery door is in a closed position; and wherein the first closure arm is flexible such that the first distal end displaces in a first direction when the battery door is moved from an open position to the closed position, the first direction in which the first distal end displaces having a primary directional component parallel to the pivot axis.

Optionally, the first direction in which the first distal end displaces has a secondary directional component perpendicular to the pivot axis, the secondary directional component being smaller than the primary directional component.

Optionally, the closure member comprises a closure body with the first closure arm extending from the closure body.

Optionally, the closure body and the first closure arm forms an angle having a value anywhere from 90 to 170 degrees.

Optionally, the closure member is made of metal.

Optionally, the closure member is made of a plastic material.

Optionally, the housing comprises a dock for receiving the closure member and for connecting the closure member to the housing.

Optionally, the first closure arm comprises a first protrusion at the first distal end.

Optionally, the closure device comprises a first secondary closure element, wherein the first closure arm is configured to engage with the first secondary closure element when the battery door is in a semi-closed position.

Optionally, the closure member comprises a second closure arm with a second distal end, the closure device comprising a second primary closure element configured to engage with the second closure arm when the battery door is in the closed position; and wherein the second closure arm is flexible such that the second distal end displaces in a second direction when the battery door is moved from the open position to the closed position, the second direction in which the second distal end displaces having a primary directional component parallel to the pivot axis.

Optionally, the first direction and the second direction are opposite.

Optionally, the first closure arm and the second closure arm form an angle larger than 5 degrees.

Optionally, the second closure arm comprises a second protrusion at the second distal end.

Optionally, the closure device comprises a first secondary closure element a second secondary closure element; wherein the first closure arm is configured to engage with the first secondary closure element when the battery door is in a semi-closed position; and wherein the second closure arm is configured to engage with the second secondary closure element when the battery door is in the semi-closed position.

A closure member for a hearing device comprising a closure body and a first closure arm, the closure body and the first closure arm forming an angle having a value that is anywhere from 90 to 170 degrees.

Other aspects and features will be evident from reading the following detailed description.

BRIEF DESCRIPTION OF THE DRAWINGS

In the following, exemplary hearing devices and parts thereof are explained in more detail with reference to the drawings, wherein FIG. 1 schematically illustrates at least partly an exemplary hearing device with a battery door, FIG. 2 schematically illustrates an exemplary battery door, FIG. 3 schematically illustrates an exemplary closure member, FIG. 4 schematically illustrates an exemplary closure member.

DETAILED DESCRIPTION

Figure 1:
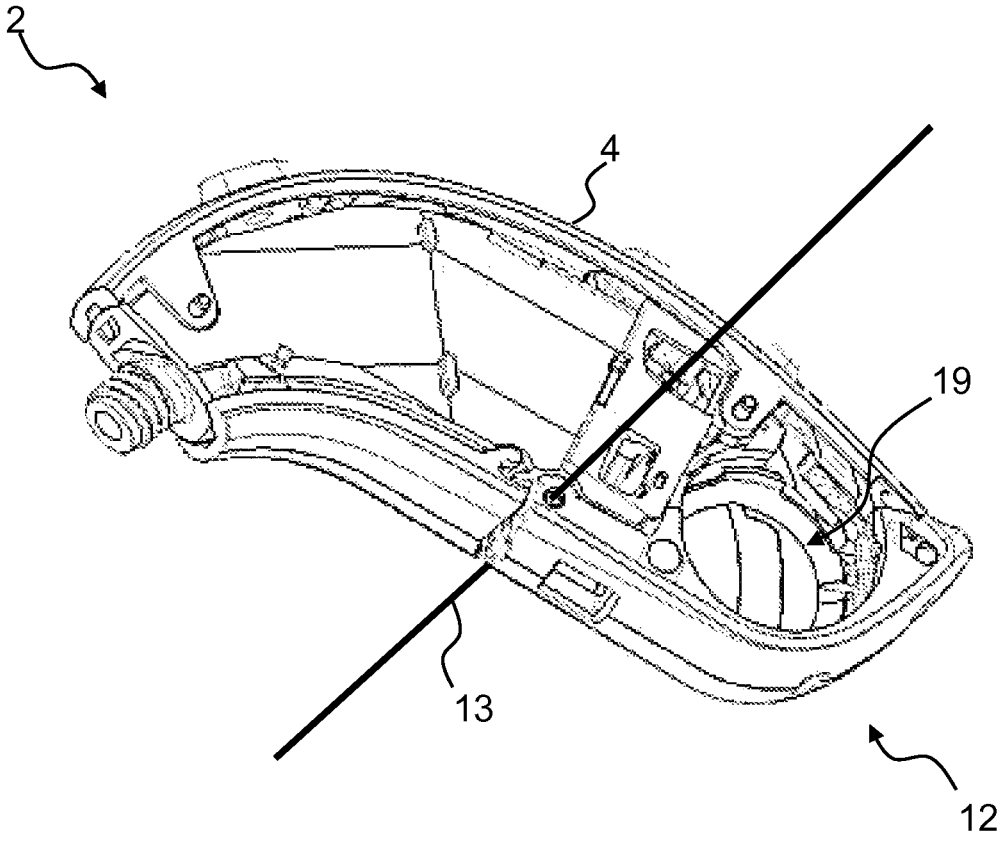

Various embodiments are described hereinafter with reference to the figures, in which exemplary embodiments are shown. The claimed invention may, however, be embodied in different forms and should not be construed as being limited to the embodiments set forth herein. Like reference numerals refer to like elements throughout. Like elements will, thus, not be described in detail with respect to the description of each figure. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

The housing of the hearing device may comprise one or more shell parts. For example, the housing may comprise a frame carrying one or more shell parts.

The closure member comprises the first closure arm with the first distal end. The first distal end is displaced in a first direction when the battery door is moved from an open (first) position to a closed (second) position or to a semi-closed (third) position. Alternatively or additionally, the first distal end may be displaced in the first direction when the battery door is moved from the closed to the open position.

The displacement of the first distal end has a primary directional component parallel to and/or within ±10 degrees of the pivot axis. The displacement of the first distal end may have a secondary directional component. The secondary directional component of the displacement of the first distal end may be perpendicular to the pivot axis. The secondary directional component of the displacement of the first distal end may be smaller than the primary directional component of the displacement of the first distal end, such as less than 50% of the primary directional component.

The first closure arm may comprise a first protrusion at the first distal end.

The first protrusion may be designed to engage with one or more recesses of the closure device of the battery door. For example, the first protrusion may be designed to engage with the first primary closure element. In the closed position, the first protrusion may be engaged with the first primary closure element. The first primary closure element may form a recess adapted to fit or accommodate the first protrusion e.g. in the closed position.

The closure device may comprise a first secondary closure element. The first closure arm may be configured to engage with the first secondary closure element when the battery door is in a semi-closed position.

The first protrusion may be designed to engage with the first secondary closure element. In the semi-closed position, the first protrusion may be engaged with the first secondary closure element. The first secondary closure element may form a recess adapted to fit or accommodate the first protrusion, e.g. in the semi-closed position.

When the user closes or opens the battery door, i.e. the battery door is moved from one position to another position, e.g. from one of the open, semi-closed or closed positions to another position of the open, semi-closed or closed positions, the first protrusion may contact an surface, e.g. a leading or trailing surface, of the first primary closure element and/or first secondary closure element and cause displacement of the first distal end of the first closure arm. Thus, the first protrusion necessitates that a user needs to exert a force on the battery door to move the battery door from one position to another position. The first protrusion retains the battery door in a position, such as the closed, semi-closed position, and/or open position.

The closure member may comprise a second closure arm with a second distal end. The closure device may comprise a second primary closure element configured to engage with the second closure arm when the battery door is in a closed position. The second closure arm may be flexible such that the second distal end displaces in a second direction when the battery door is moved from the open position to the closed position. Alternatively or additionally, the second distal end may be displaced in the second direction when the battery door is moved from the closed to the open position. The displacement of the second distal end may have a primary directional component parallel to the pivot axis. Furthermore, the displacement of the second distal end may have a secondary directional component. The secondary directional component of the displacement of the second distal end may be perpendicular to the pivot axis. The secondary directional component of the displacement of the second distal end may be smaller than the primary directional component of the displacement of the second distal end, such as less than 50% of the primary directional component.

The second closure arm may comprise a second protrusion at the second distal end.

The second protrusion may be designed to engage with one or more recesses of the closure device of the battery door. For example, the second protrusion may be designed to engage with the second primary closure element. In the closed position, the second protrusion may be engaged with the second primary closure element. The second primary closure element may form a recess adapted to fit or accommodate the second protrusion.

The closure device may comprise a second secondary closure element. The second closure arm may be configured to engage with the second secondary closure element when the battery door is in a semi-closed position.

The second protrusion may be designed to engage with the second secondary closure element. In the semi-closed position, the second protrusion may be engaged with the second secondary closure element. The second secondary closure element may form a recess adapted to fit or accommodate the second protrusion.

A closure element, such as the first primary closure element, the first secondary closure element, the second primary closure element, and/or the second secondary closure element, may comprise a leading surface, a first surface, a trailing surface and/or a second surface. The leading surface and/or the trailing surface of the closure element may be inclined relative to an axis parallel to the pivot axis. The first surface and/or the second surface of the closure element may be perpendicular to an axis parallel to the pivot axis.

A closure arm, such as the first closure arm and/or second closure arm, may comprise a leading surface, a first surface and/or a trailing surface. The leading surface and/or the trailing surface of the closure arm may be inclined relative to an axis parallel to the pivot axis. The first surface of the closure arm may be perpendicular to an axis parallel to the pivot axis. The leading surface, the first surface and/or the trailing surface of the closure arm may form the first and/or second protrusion.

When the user closes or opens the battery door, i.e. the battery door is moved from one position to another position, e.g. from one of the open, semi-closed or closed positions to another position of the open, semi-closed or closed positions, the second protrusion may contact an surface, e.g. the leading or trailing surface, of the second primary closure element and/or second secondary closure element and cause displacement of the second distal end of the second closure arm. Thus, the second protrusion necessitates that a user needs to exert a force on the battery door to move the battery door from one position to another position. The second protrusion retains the battery door in a position, such as the closed, semi-closed position, and/or open position.

The first closure element(s), i.e. the first primary closure element and/or the secondary closure element, may be arranged oppositely to the second closure element(s), i.e. the second primary closure element and/or the second secondary closure element. For example, the first closure element(s) may face the second closure element(s), or the first closure element(s) may face away from the second closure element(s).

The first direction and/or the primary directional component of the first direction and the second direction and/or the primary directional component of the second direction may be opposite. For example, the first direction and/or the primary directional component of the first direction and the second direction the primary directional component of the second direction may be towards each other, or the first direction and/or the primary directional component of the first direction and the second direction and/or the primary directional component of the second direction may be away from each other.

The first primary closure element may be arranged oppositely the second primary closure element, such that the first protrusion engage the first primary closure element concurrently, or substantially concurrently, with the second protrusion engaging the second primary closure element. Alternatively and/or additionally, the first secondary closure element may be arranged oppositely the second secondary closure element, such that the first protrusion engage the first secondary closure element concurrently, or substantially concurrently, with the second protrusion engaging the second secondary closure element.

Arranging closure elements opposite each other reduces internal stress of the closure element and/or distributes the internal stress more appropriately.

The first protrusion and the second protrusion may extend in opposite directions. For example, the first protrusion and the second protrusion may extend towards and/or facing each other, or the first protrusion and the second protrusion may extend away from each other.

Arranging the first direction and second direction to be opposite, or at least their respective primary directional components to be opposite and/or the first protrusion and the second protrusion to extend in opposite directions, may provide a closure device with reduced requirement to the fastening to the hearing device housing, since a force generating displacement of the first distal end in the first direction is balanced, or at least partly balanced, by another force generating displacement of the second distal end in the second direction.

Balancing forces, reducing internal stress and/or distributing internal stress reduces requirements to the material and manufacturing processes, and reduces the risk of failing parts. Furthermore, an increased design freedom and reduction in size may be achieved.

The first closure arm and the second closure arm may form an angle larger than 5 degrees, such as larger than 10 degrees, such as larger than 15 degrees. The first closure arm may extend along a first arm axis. The second closure arm may extend along a second arm axis. The first arm axis and the second arm axis may intersect with forming an angle larger than 5 degrees, such as larger than 10 degrees, such as larger than 15 degrees. The angle between the first closure arm and the second closure arm provide that the closure body may be reduced in size, thus, reducing the size of the hearing device.

The primary directional component of the displacement of the first and/or second distal end may be larger than 0.1 mm, such as larger than 0.3 mm, such as larger than 0.8 mm.

The ratio between the primary and secondary directional component of the displacement of the first and/or second distal end may be more than 2:1, such as more than 5:1, such as more than 10:1, wherein the secondary directional component is smaller than the primary directional component.

The closure member may comprise a closure body with the first closure arm and/or the second closure arm extending from the closure body. The closure body may have one or more through holes or one or more cut-outs. One or more through holes or cut-outs in the closure body may facilitate improved stress distribution and/or reduced internal strain in the closure member. Further or alternatively, the elastic properties of the closure arm(s) may be controlled and/or higher design freedom in the dimensions of the closure arms may be allowed. The closure body or parts thereof may be configured for engagement with a dock of the housing.

The closure body and the first closure arm and/or the second closure arm may form an angle less than 180 degrees, such as in the range from 90 to 170 degrees, such as in the range from 110 to 150 degrees, such as in the range from 120 to 130 degrees. The angle between the closure body and the closure arm(s) may provide easier closure of the battery door. The angle provides the closure device of the battery door to engage with the closure member while the battery door is rotating about the pivot axis. Furthermore, the angle provides the possibility of arranging the closure device close to the perimeter of the battery compartment, thus, achieving a small sized battery door and hearing device.

The closure member may be removably attached to the housing. The housing may comprise a dock for receiving the closure member and connecting the closure member to the housing. The dock may be configured for engagement with a closure body or parts thereof.

The dock and/or the closure body may comprise locking element(s), such as a dock locking element and/or a closure body locking element. The locking element(s) may act to retain the closure member when the closure body is inserted into the dock, e.g. providing a press-fit-lock, a click-lock and/or a twist-lock.

The dock may comprise a dock locking element, e.g. a protrusion and/or a recess. The closure body may comprise a closure body locking element, e.g. a protrusion and/or a recess. The dock locking element and/or the closure body locking element may interact to retain the closure member when the closure body is inserted into the dock.

The dock may comprise a first rail for receiving a first side of the closure body. Additionally, the dock may comprise a second rail opposite the first rail. The second rail may be adapted to receive a second side of the closure body.

The closure member may be received in the dock by sliding the closure body into the dock in a direction parallel, or substantially parallel, to a plane defined by the closure body.

The closure member may be received in the dock by depressing the closure body into the dock in a direction perpendicular, or substantially perpendicular, to a plane defined by the closure body.

The provision of a dock for receiving the closure member, allows for the closure member to be independent from the housing. The closure member being independent from the housing allow increased design and manufacturing possibilities, and facilitate that the closure member may be replaced, e.g. upon failure.

The closure member may be made from different materials, each with different benefits, such as wear resistance, ductility, flexibility and surface friction. The closure member may be made of metal. The closure member may be made of a plastic material, such as POM (Polyoxymethylene) and/or ABS (acrylonitrile butadiene styrene). For example, POM may be beneficial due to its flexible ability and surface friction.

FIG. 1 schematically illustrates an exemplary hearing device 2 with a battery door 12. The hearing device 2 comprises a housing 4. The battery door 12 comprises a battery compartment 19. The battery door 12 is pivotally connected to the housing 4, and pivots about a pivot axis 13, which allows the battery door to rotate between an open and a closed position. In FIG. 1, the battery door 12 is shown in the closed position.

Figure 2:
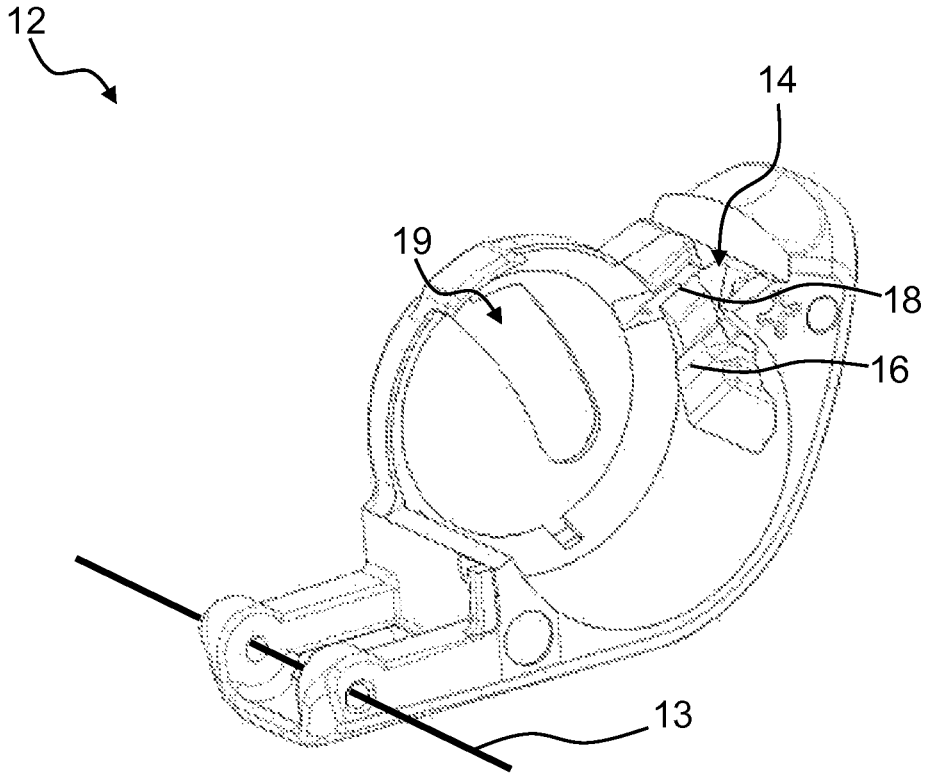

FIG. 2 schematically illustrates an exemplary battery door 12 with a closure device 14. The closure device 14 comprises a first primary closure element 16 and an optionally first secondary closure element 18. FIG. 2 furthermore depicts the pivot axis 13.

The first primary closure element 16 and the first secondary closure element 18 are recesses extending in a direction substantially parallel to the pivot axis 13. The first primary closure element 16 and the first secondary closure element 18 are adapted to receive the first and/or second protrusion of the closure member.

Figure 3:
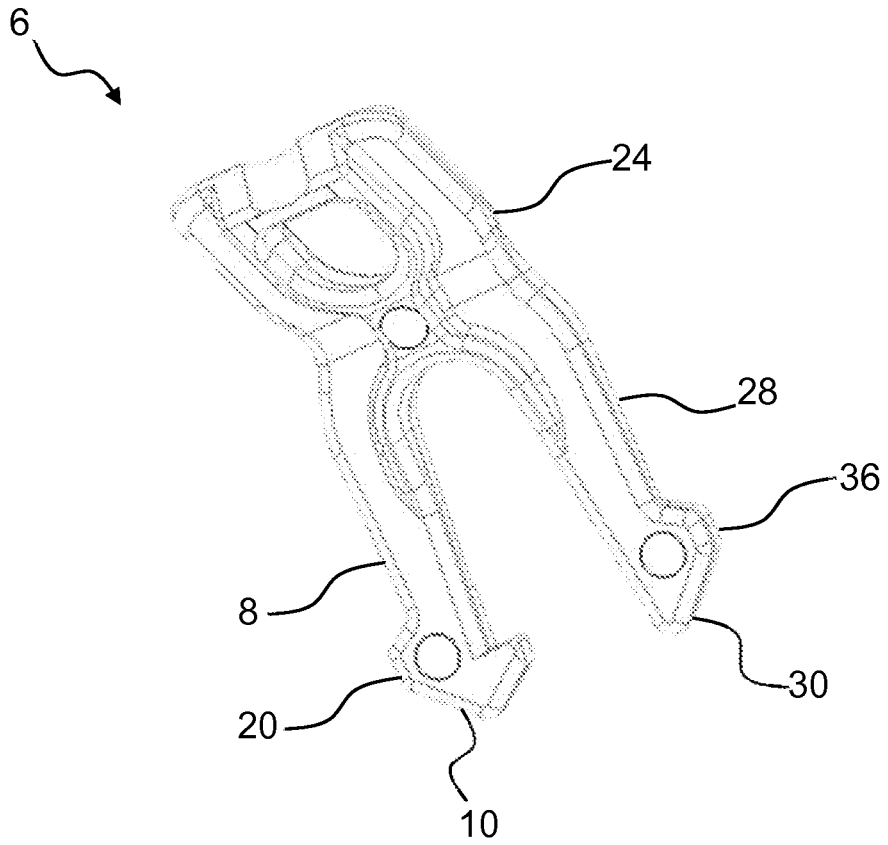

FIG. 3 schematically illustrates an exemplary closure member 6. The closure member 6 comprises a first closure arm 8 with a first distal end 10. The closure member 6 depicted furthermore comprises a second closure arm 28 with a second distal end 30. The closure member 6 comprises a closure body 24, and the first closure arm 8 and the second closure arm 28 extends from the closure body 24.

The first closure arm 8 comprises a first protrusion 20. The first protrusion 20 is located distal from the closure body. The first protrusion is, in FIG. 3, depicted at the first distal end 10 of the first closure arm 8.

The second closure arm 28 comprises a second protrusion 36. The second protrusion 36 is located distal from the closure body. The second protrusion is, in FIG. 3, depicted at the second distal end 30 of the second closure arm 28.

Figure 4:
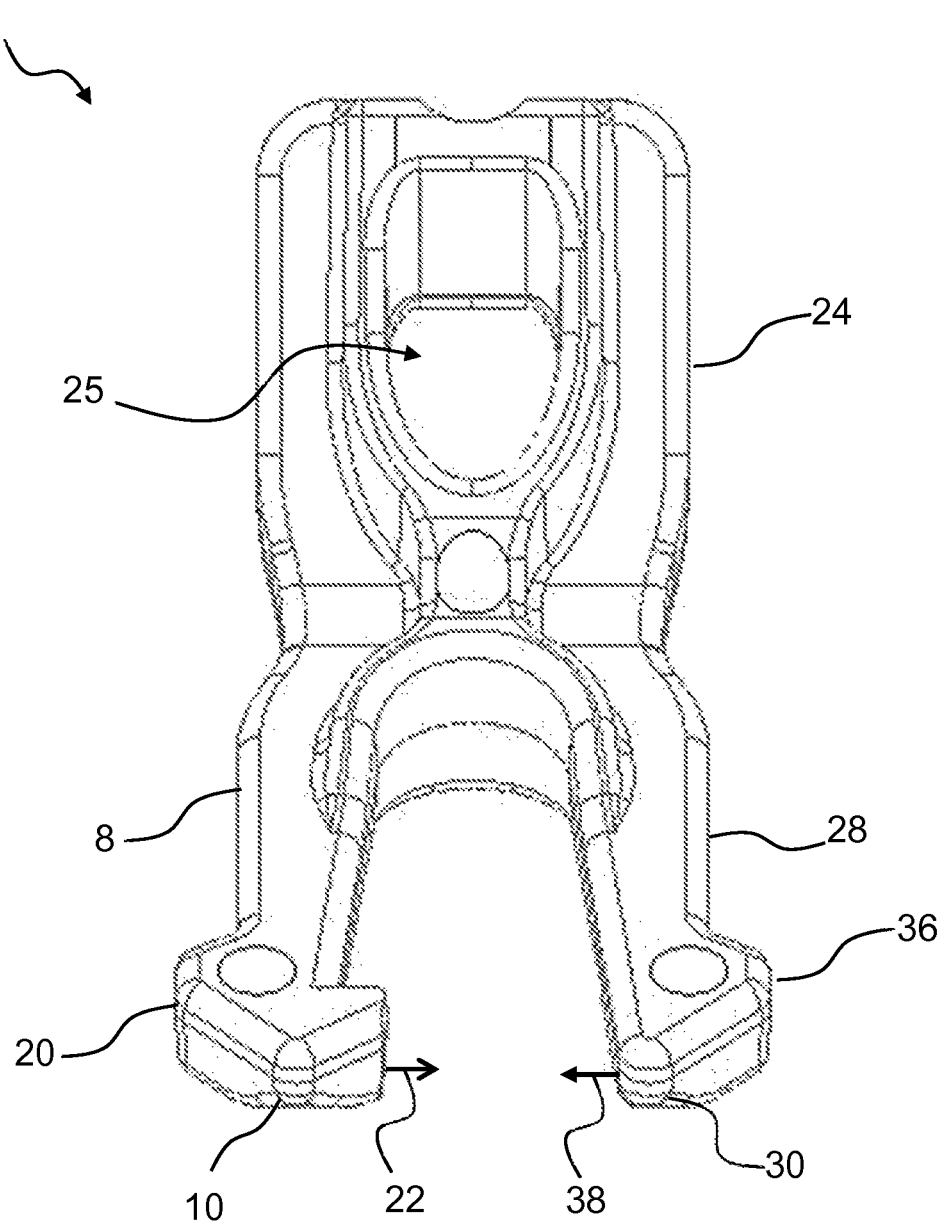

FIG. 4 schematically illustrates an exemplary closure member 6 seen from a frontal view. The closure member 6 comprises a first closure arm 8 with a first distal end 10 and a first protrusion 20. The closure member 6 furthermore comprises a second closure arm 28 with a second distal end 30 and a second protrusion 36. The closure member 6 comprises a closure body 24, and the first closure arm 8 and the second closure arm 28 extends from the closure body 24.

The first closure arm 8 is flexible, such that the first distal end 10 is displaceable in a first direction 22. The second closure arm 28 is flexible, such that the second distal end 30 is displaceable in a second direction 22.

The closure body 24 comprises a through hole 25. The through hole serves as mean to reduce internal stress in the closure body 24 when the distal ends 10, 30 of the first closure arm 8 and the second closure arm 28 are displaced in the respective first 22 and second 38 directions.

The first protrusion 20 is adapted to fit in the first primary closure element 16 and/or the first secondary closure element 18 of the closure device 14. The second protrusion 36 is adapted to fit in the second primary closure element 32 and/or the second secondary closure element 34 of the closure device 14.

When the closure device 14 is engaging with the closure member 6, the first closure arm 8 is displaced in the first direction 22 and/or the second closure arm 28 is displaced in the second direction 38. The displacements are in the depicted example due partly to the shape of the first protrusion 20 and the second protrusion 36. Additionally and/or alternatively, the displacements may be due to the shape of the closure device 14.

Figure 5:
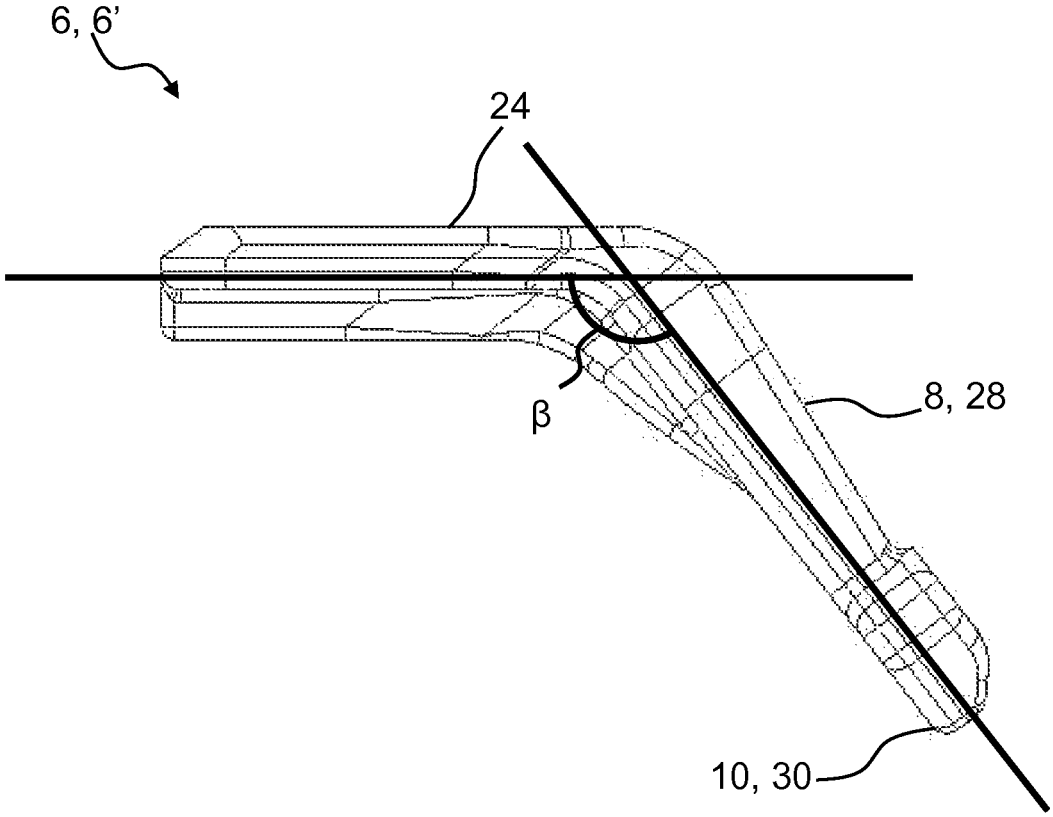
FIG. 5 is a side view of a closure member, FIGS. 6A and 6B schematically illustrate a hearing device with a battery door in an open position, FIGS. 7A and 7B schematically illustrate a hearing device with a battery door in a closed position, FIGS. 8A and 8B schematically illustrate a hearing device with a battery door in a semi-closed position, FIGS. 9 and 10 schematically illustrate an exemplary closure device and an exemplary closure member, FIG. 11 schematically illustrates an exemplary hearing device housing with a closure member, and FIG. 12 schematically illustrates an exemplary closure member.

FIG. 5 schematically illustrates an exemplary closure member 6 seen from a side view. FIG. 5 illustrates that the first closure arm 8 and the second closure arm 28 extends from the closure body 24 with a closure body arm angle β. The closure body arm angle β may be between 90-180 degrees, such as between 105-140 degrees. FIG. 5 depicts the first closure arm 8 and the second closure arm 28 extending from the closure body 24 with a closure body arm angle β of substantially the same magnitude. However the first closure arm 8 and the second closure arm 28 may extend from the closure body 24 with different angles, such as the first closure arm 8 may extend from the closure body 24 with a first closure body arm angle $\beta_1$ and the second closure arm 28 may extend from the closure body 24 with a second closure body arm angle $\beta_2$.

Figure 6A:
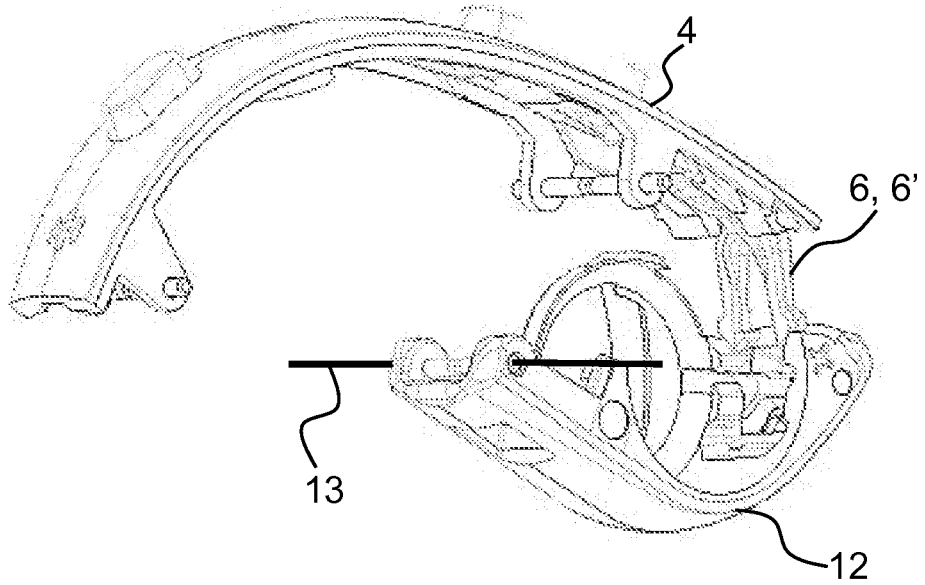
Figure 6B:
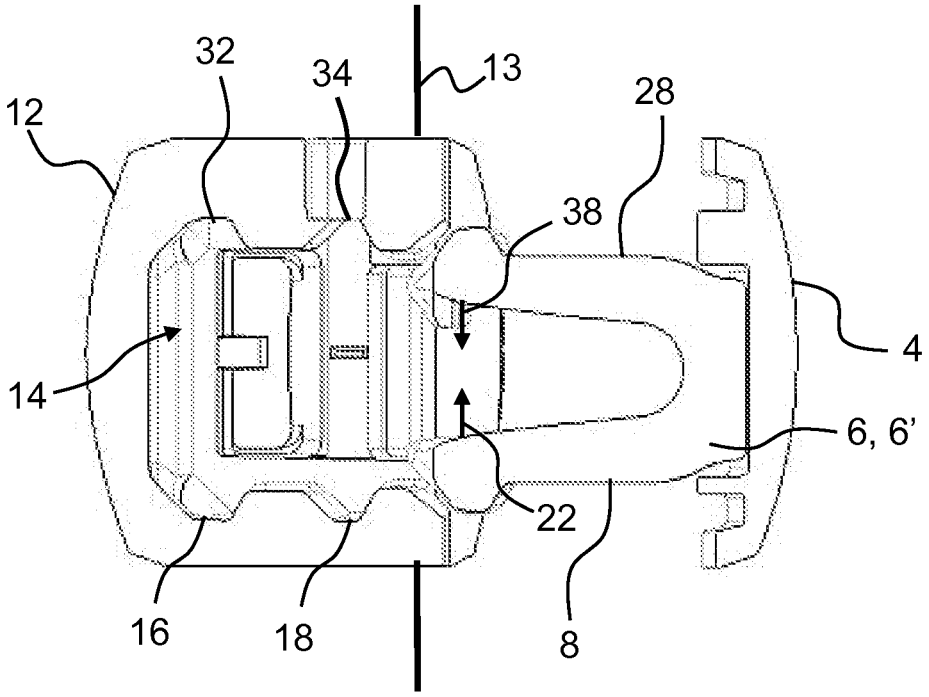

FIGS. 6A and 6B schematically illustrates an exemplary hearing device housing 4 with a closure member 6 and a battery door 12 in an open position. The battery door 12 is rotatable about the pivot axis 13.

As seen in FIG. 6B the battery door 12 comprises the closure device 14. The closure device comprises a first primary closure element 16, a first secondary closure element 18, a second primary closure element 32 and a second secondary closure element 34. When the battery door is rotated about the pivot axis 13 towards a closed position the first closure arm 8 is displaced in the first direction 22, and the second closure arm 28 is displaced in the second direction 38.

Upon rotation of the battery door towards a closed position, the contact between the inclined faces of the distal ends of the first 8 and second closure arm 38, and the inclined face of the closure device 14, causes the first closure arm and the second closure arm 38 to be displaced in respective first direction 22 and second direction 38.

Figure 7A:
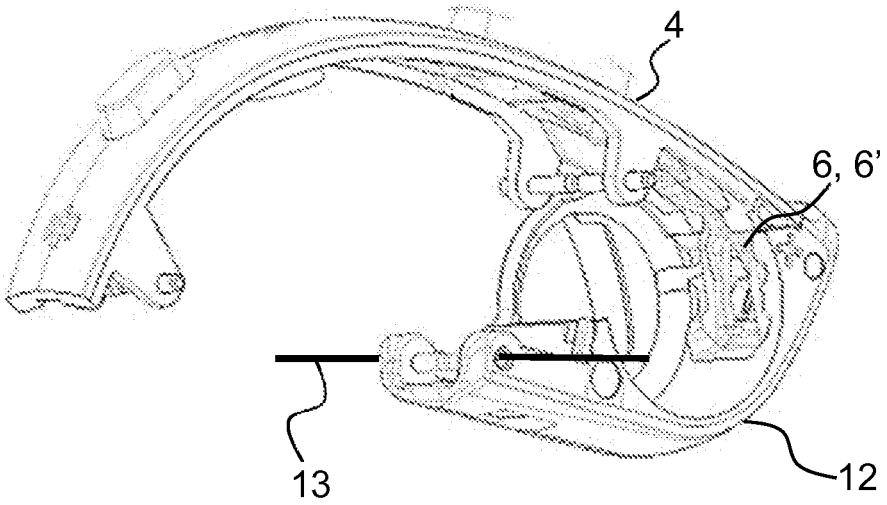
Figure 7B:
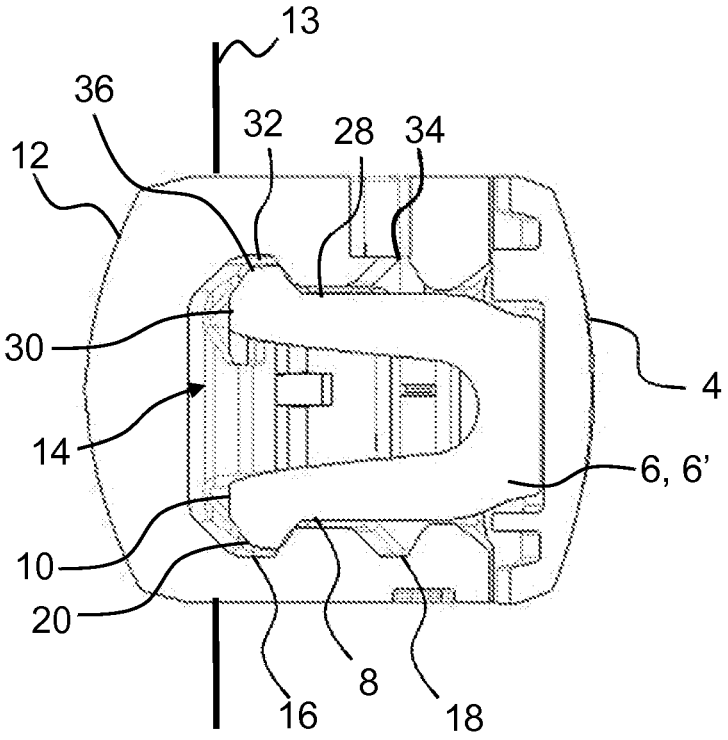

FIGS. 7A and 7B schematically illustrate an exemplary hearing device housing 4 with a closure member 6 and a battery door 12 in a closed position. The battery door 12 is rotatable about the pivot axis 13. Compared to the open position as illustrated in FIGS. 5A and 5B, the battery door 12 has been rotated about the pivot axis 13 and the closure device 14 of the battery door 12 is engaged with the closure element 6.

The first protrusion 20 of the first closure arm 8 is engaged with the first primary closure element 16, and the battery door 12 is thus retained in the closed position.

Additionally, the depicted example shows the closure member 6 comprising a second closure arm 28 having a second protrusion 36. The second protrusion 36 is engaged with a second primary closure element 32 of the closure device 14. Thus, in the depicted example, the battery door 12 is additionally retained in the closed position by the second protrusion 36 being engaged with the second primary closure element 32.

The closed position as depicted in FIGS. 7A and 7B may be an on-position wherein an electrical circuit is electrically connected to a battery positioned in the battery door such that the hearing device is powered by the battery.

The flexibility of the first closure arm 8 and the second closure arm 28, and the recesses provided by the first primary closure element 16 and the second primary closure element 32, provides that the first distal end 10 and the second distal end 30 are displaced opposite their respective first direction 22 and second direction 38 when the battery door 12 has been rotated to the closed position.

It is clear that a rotation of the battery door 12 about the pivot axis 13 from the closed position as illustrated in FIGS. 7A and 7B to the open position as illustrated in FIGS. 6A and 6B involves a displacement in the first direction 22 of the first distal end 10 and a displacement in the second direction 38 of the second distal end 30. When the battery door is in the open position, the first distal end 10 and the second distal end 30 will reclaim their initial, relaxed, position by being displaced opposite the first direction 22 and the second direction 38, respectively, due to the flexibility of the first closure arm 8 and the second closure arm 28.

It is readily apparent that the flexibility of the first closure arm 8 and the second closure arm 16 may be obtained by the material and design of the entire closure member 6.

Figure 8A:
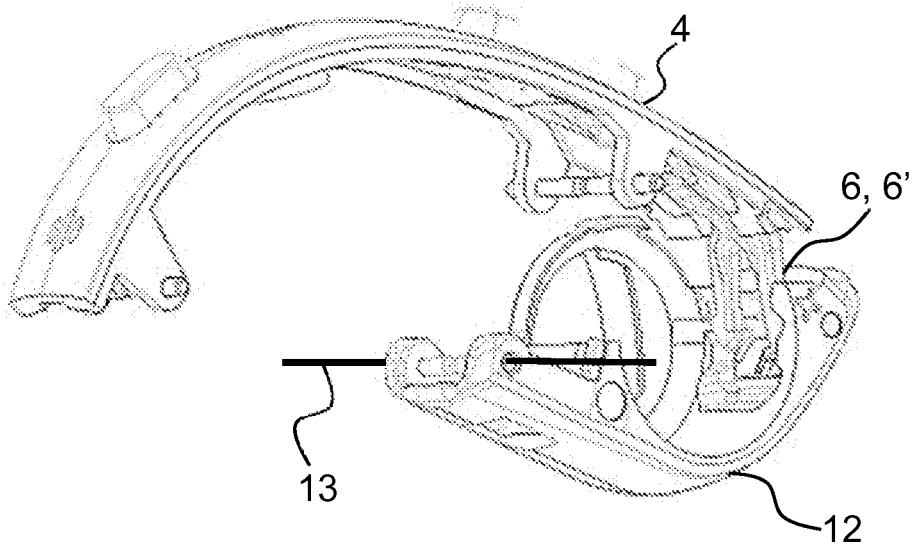
Figure 8B:
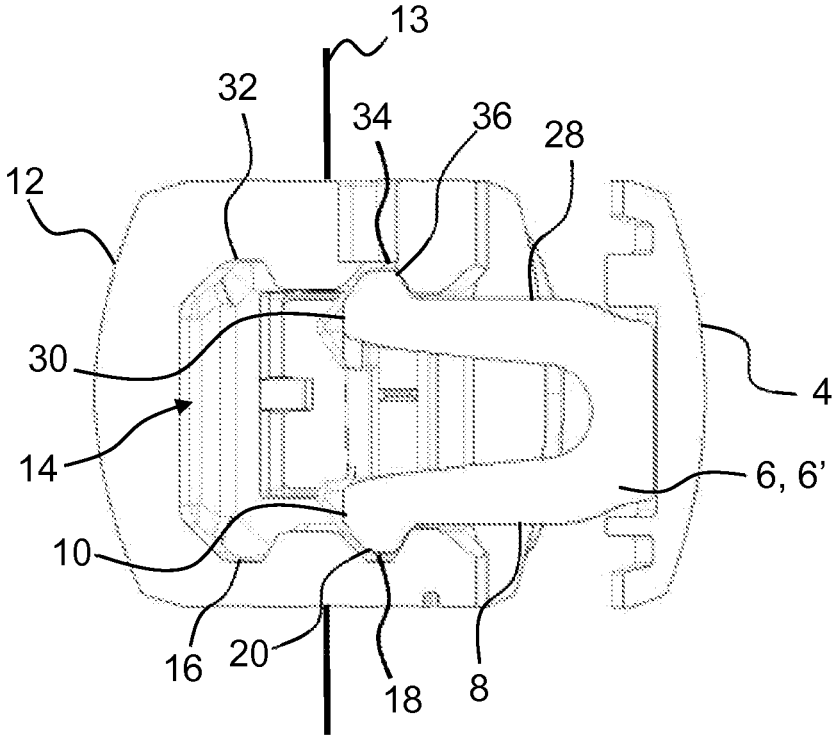

FIGS. 8A and 8B schematically illustrate an exemplary hearing device housing 4 with a closure member 6 and a battery door 12 in a semi-closed position. The battery door 12 is rotatable about the pivot axis 13. Compared to the open position as illustrated in FIGS. 6A and 6B and the closed position as illustrated in FIGS. 7A and 7B, the battery door 12 has been rotated about the pivot axis 13 and the closure device 14 is engaged with the closure element 6 in the semi-closed position.

The semi-closed position is defined by the closure device comprising a first secondary closure element 18 and optionally a second secondary closure element 34. In the semi-closed position the first protrusion 20 is engaged with the first secondary closure element 18 and/or the second protrusion 36 is engaged with the second secondary closure element 34.

Figure 9:
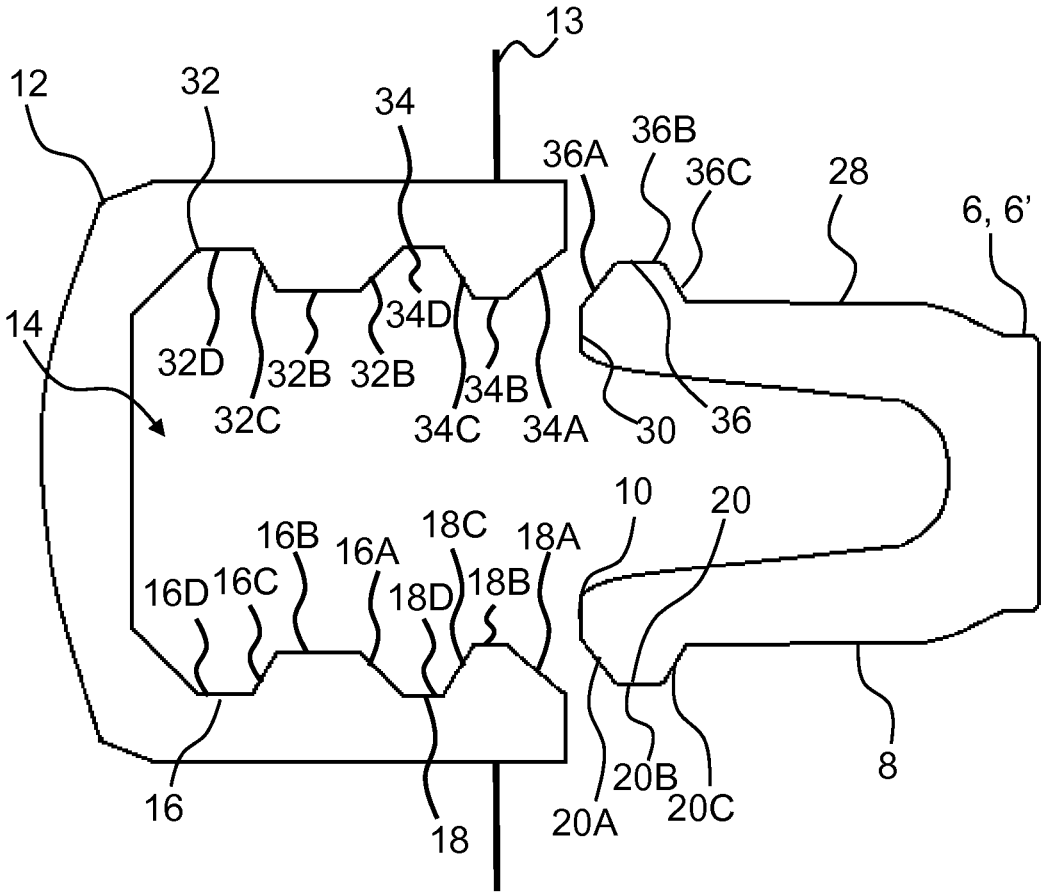

FIG. 9 schematically illustrates an exemplary closure device 14 and an exemplary closure member 6. The closure device 14 comprises a first primary closure element 16. The closure device 14 depicted in FIG. 9 furthermore comprises the optional first secondary closure element 18, optional second primary closure element 32 and optional second secondary closure element 34. Each of the closure elements 16, 18, 32, 34 comprises a leading surface 16A, 18A, 32A, 34A, a first surface 16B, 18B, 32B, 34B, a trailing surface 16C, 18C, 32C, 34C, and a second surface 16D, 18D, 32D, 34D. The closure member 6 comprises a first closure arm 8 and an optional second closure arm 28. A first protrusion 20 is situated near a first distal end 10 of the first closure arm 8. A second protrusion 36 is situated near a second distal end 30 of the second closure arm 28.

Each of the first and second protrusions 20, 36 comprises a leading surface 20A, 36A, a distal surface 20B, 36B, and a trailing surface 20C, 36C, respectively.

Figure 10:
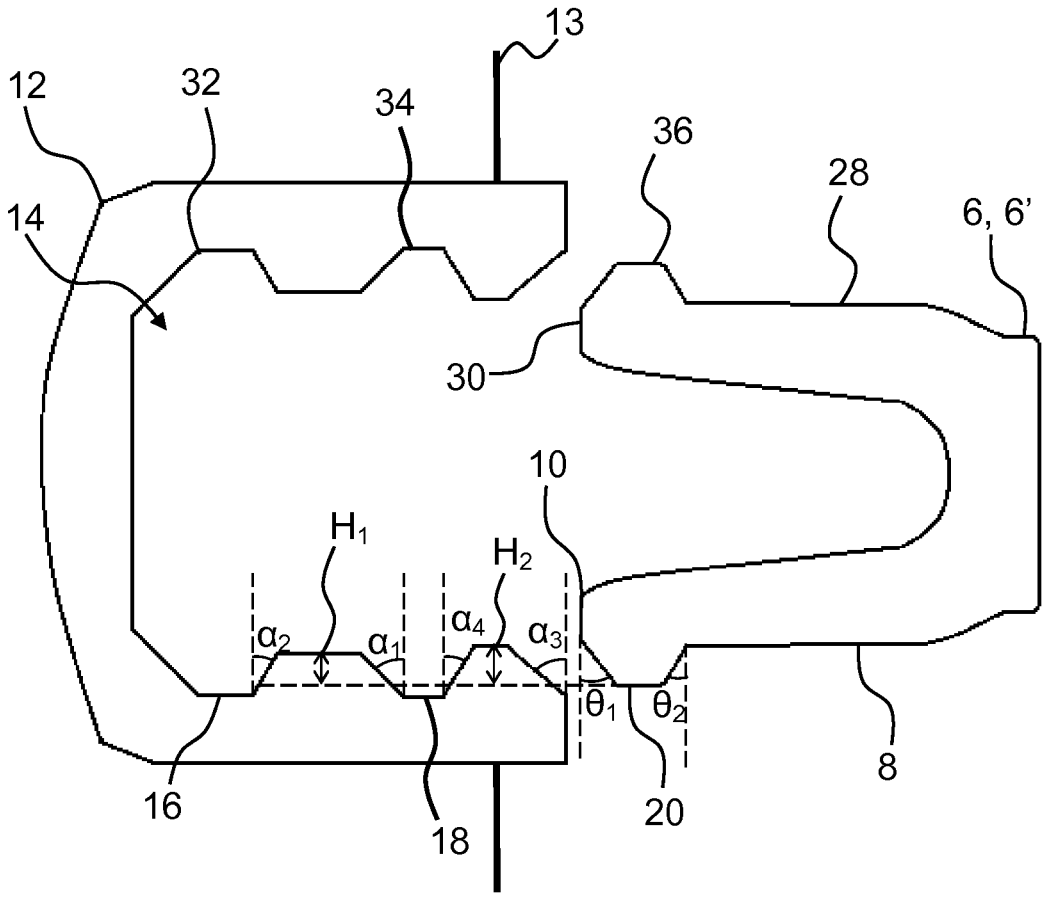

FIG. 10 schematically illustrates the exemplary closure device 14 and the exemplary closure member 6 as also depicted in FIG. 9. In FIG. 10 some reference numbers have been omitted for increased intelligibility.

The leading surface 20A of the first closure arm 8 is inclined by a closure arm leading surface angle $\theta_1$. The trailing surface 20C of the first closure arm 8 is inclined by a closure arm trailing surface angle $\theta_2$. As illustrated in FIGS. 9 and 10, the leading surface 36A and trailing surface 36C of the second closure arm 28 may exhibit similar angles as the leading surface 20A and trailing surface 20C of the first closure arm 8. However, in other exemplary closure members the shape of the second closure arm 28 may be different from the first closure arm 8.

The leading surface 16A of the first primary closure element 16 is inclined by a primary closure element leading surface angle $\alpha_1$, and the trailing surface 16C of the first primary closure element 16 is inclined by a primary closure element trailing surface angle $\alpha_2$. The first surface 16B of the first primary closure element 16 has a primary closure element height $H_1$. The primary closure height $H_1$ may be in the range of 0.1-0.5 mm, or in the range of 0.2-0.4 mm, or in the range of 0.25-0.35 mm.

The leading surface 18A of the first secondary closure element 18 is inclined by a secondary closure element leading surface angle $\alpha_3$, and the trailing surface 18C of the first secondary closure element 18 is inclined by a secondary closure element trailing surface angle $\alpha_4$. The first surface 18B of the first secondary closure element 18 has a secondary closure element height $H_2$. The secondary closure height $H_2$ may be in the range of 0.1-0.6 mm, or in the range of 0.2-0.5 mm, or in the range of 0.3-0.4 mm.

As illustrated in FIG. 10, the leading surface 32A, the trailing surface 32C and the first surface 32B of the second primary closure element 32 may exhibit similar angles and heights as the leading surface 16A, the trailing surface 16C and the first surface 16B of the first primary closure element 16. Furthermore, the leading surface 34A, the trailing surface 34C and the first surface 34B of the second secondary closure element 34 may exhibit similar angles and heights as the leading surface 18A, the trailing surface 18C and the first surface 18B of the first secondary closure element 18. However, in other exemplary closure devices the shape of the second primary closure element 32 and the second secondary closure element 34 may be different from the shape of the first primary closure element 16 and/or the first secondary closure element 18.

The angles mentioned are measured, as illustrated in FIG. 10, between the respective surface and an intersecting axis which is parallel to the pivot axis 13.

The closure arm leading surface angle $\theta_1$, the primary closure element leading surface angle $\alpha_1$ and/or the secondary closure element leading surface angle $\alpha_3$ may be between 25-70 degrees, such as between 30-60 degrees, such as between 35-50 degrees.

The closure arm leading surface angle $\theta_1$ may be matched with the primary closure element leading surface angle $\alpha_1$ and/or the secondary closure element leading surface angle $\alpha_3$. For example, the closure arm leading surface angle $\theta_1$, the primary closure element leading surface angle $\alpha_1$ and/or the secondary closure element leading surface angle $\alpha_3$ may be substantially equal, such as within 10 degrees difference, or within 5 degrees, e.g. in order to provide a smooth closure.

The primary closure element leading surface angle $\alpha_1$ and the secondary closure element leading surface angle $\alpha_3$ may differ by more than 2 degrees, such as more than 4 degrees, such as more than 6 degrees. The difference between the primary closure element leading surface angle $\alpha_1$ and the secondary closure element leading surface angle $\alpha_3$ may be beneficial to provide the user with a different feel in pivoting the battery door 12 from the open to the semi-closed position and pivoting the battery door 12 from the semi-closed position to the closed position.

The closure arm trailing surface angle $\theta_2$, the primary closure element trailing surface angle $\alpha_2$ and/or the secondary closure element trailing surface angle $\alpha_4$ may be between 30-80 degrees, such as between 45-70 degrees, such as between 55-65 degrees.

The closure arm trailing surface angle $\theta_2$ may be matched with the primary closure element trailing surface angle $\alpha_2$ and/or the secondary closure element trailing surface angle $\alpha_4$. For example, the closure arm trailing surface angle $\theta_2$, the primary closure element trailing surface angle $\alpha_2$ and/or the secondary closure element trailing surface angle $\alpha_4$ may be substantially equal, such as within 10 degrees difference, or within 5 degrees, e.g. in order to provide a smooth opening.

The primary closure element trailing surface angle $\alpha_2$ and the secondary closure element trailing surface angle $\alpha_4$ may differ by more than 2 degrees, such as more than 4 degrees, such as more than 6 degrees. The difference between the primary closure element trailing surface angle $\alpha_2$ and the secondary closure element trailing surface angle $\alpha_4$ may be beneficial to provide the user with a different feel in pivoting the battery door 12 from the closed to the semi-closed position and pivoting the battery door 12 from the semi-closed position to the open position.

The primary closure element leading surface angle $\alpha_1$ and the primary closure element trailing surface angle $\alpha_2$ may differ by more than 2 degrees, such as more than 4 degrees, such as more than 6 degrees. The difference between the primary closure element leading surface angle $\alpha_1$ and the primary closure element trailing surface angle $\alpha_2$ may be beneficial to provide the user with a different feel in pivoting the battery door 12 from the closed to the semi-closed or open position and pivoting the battery door 12 from the semi-closed or open position to the closed position.

The primary closure element leading surface angle $\alpha_1$ may be bigger than the primary closure element trailing surface angle $\alpha_2$, thereby providing a battery door where the force required to pivot the battery door 12 from the open or semi-closed position to the closed position is less than the force required to pivot the battery door 12 from the closed to the semi-closed or open position.

The battery door 12 is pivoted from the closed to the open position, and conversely from the open position to the closed position, if the optional first secondary closure element 18 is omitted.

The secondary closure element leading surface angle $\alpha_3$ and the secondary closure element trailing surface angle $\alpha_4$ may differ by more than 2 degrees, such as more than 4 degrees, such as more than 6 degrees. The difference between the secondary closure element leading surface angle $\alpha_3$ and the secondary closure element trailing surface angle $\alpha_4$ may be beneficial to provide the user with a different feel in pivoting the battery door 12 from the semi-closed to the open position and pivoting the battery door 12 from the open position to the semi-closed position.

The secondary closure element leading surface angle $\alpha_3$ may be bigger than the secondary closure element trailing surface angle $\alpha_4$, thereby providing a battery door 12 where the force required to pivot the battery door 12 from the semi-closed position to the closed position is less than the force required to pivot the battery door 12 from the open position to the semi-closed position.

The primary closure element height $H_1$ and the secondary closure element height $H_2$ are indicative of the displacement of the first distal end 10 needed for the closure device 14 to engage with the first closure arm 8. Thus, the closure element heights $H_1$, $H_2$ are measured relative to the first surface 20B of closure arm 8 when the closure element 6 is in a relaxed state, i.e. not in contact with the closure device 14, such as in the open position.

The primary closure element height $H_1$ and the secondary closure element height $H_2$ may be different to provide the user with a different feel in pivoting the battery door 12 between the open position and semi-closed position and pivoting the battery door 12 between the semi-closed position and the closed position. For example, the secondary closure element height $H_2$ may be larger than the primary closure element height $H_1$.

Figure 11:
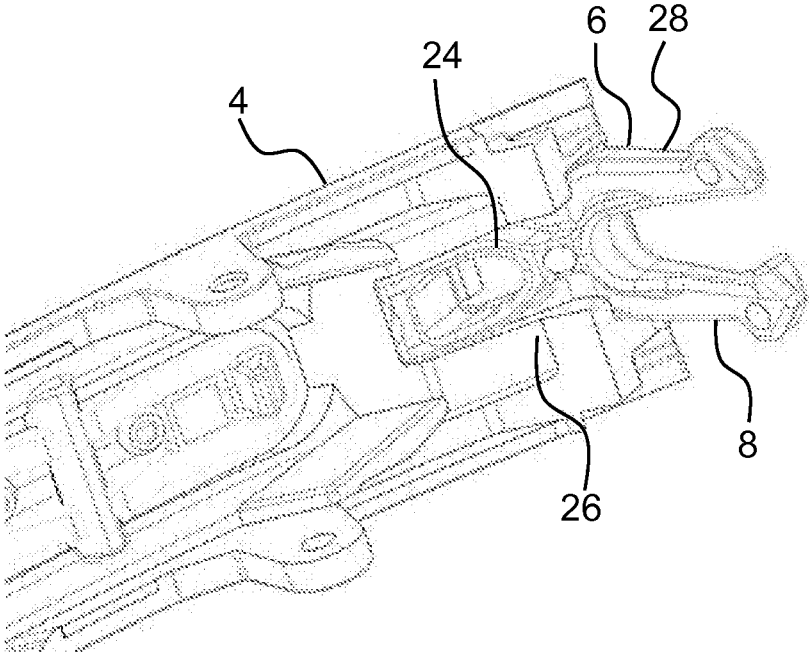

FIG. 11 schematically illustrates an exemplary hearing device housing 4 with a closure member 6. The closure member 6 is similar to the closure member 6 as described in relation to the previous figures. The housing comprises a dock 26 adapted to receive the closure member 6, and connecting the closure member 6 to the housing 4. Thus, the closure member 6 is removably attached to the housing 4. The dock 26 is adapted to slidably receive and engage with the closure body 24 of the closure member 6.

Figure 12:
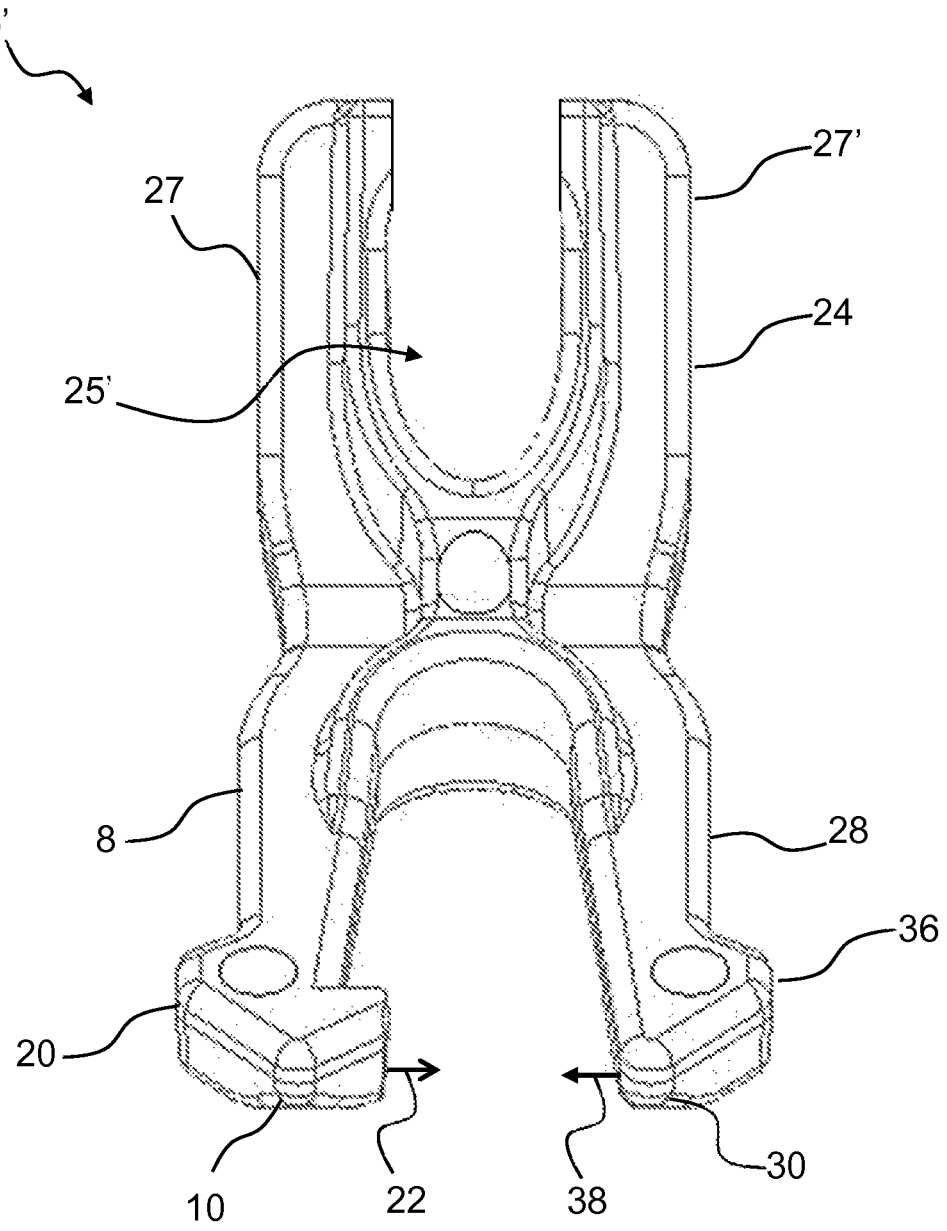

FIG. 12 schematically illustrates an exemplary closure member 6' seen from a frontal view. The closure member 6' is similar to the closure member 6 as described in FIG. 4. However, the closure body 24 of closure member 6' has a cut-out 25'. The cut-out 25' serves as mean to reduce internal stress in the closure body 24 when the distal ends 10, 30 of the first closure arm 8 and the second closure arm 28 are displaced in the respective first 22 and second 38 directions.

The formation of a cut-out 25' in the closure body 24 provides that the closure body 24 comprises a first closure body lock arm 27 and/or a second closure body lock arm 27'. The first and second closure body lock arms 27, 27' may act to lock the closure member 6' when inserted in a dock 26 of a hearing device housing 4 as described in relation to FIG. 11.

Although particular embodiments have been shown and described, it will be understood that it is not intended to limit the claimed inventions to the preferred embodiments, and it will be obvious to those skilled in the art that various changes and modifications may be made without department from the spirit and scope of the claimed inventions. The specification and drawings are, accordingly, to be regarded in an illustrative rather than restrictive sense. The claimed inventions are intended to cover alternatives, modifications, and equivalents.

LIST OF REFERENCES

2 hearing device
4 housing
6 closure member
8 first closure arm
10 first distal end
12 battery door
13 pivot axis
14 closure device
16 first primary closure element
16A leading surface of first primary closure element
16B first surface of first primary closure element
16C trailing surface of first primary closure element
16D second surface of first primary closure element
18 first secondary closure element
18A leading surface of first secondary closure element
18B first surface of first secondary closure element
18C trailing surface of first secondary closure element
18D second surface of first secondary closure element
19 battery compartment
20 first protrusion
20A leading surface of first closure arm
20B first surface of first closure arm
20C trailing surface of first closure arm
22 first direction
24 closure body
25 through hole
25' cut-out
26 dock
27 first closure body lock arm
27' second closure body lock arm
28 second closure arm
30 second distal end
32 second primary closure element
32A leading surface of second primary closure element
32B first surface of second primary closure element
32C trailing surface of second primary closure element
32D second surface of second primary closure element
34 second secondary closure element
34A leading surface of second secondary closure element
34B first surface of second secondary closure element
34C trailing surface of second secondary closure element
34D second surface of second secondary closure element
36 second protrusion
36A leading surface of second closure arm
36B first surface of second closure arm
36C trailing surface of second closure arm
38 second direction
50 displacement of first distal end
52 primary directional component of displacement of first distal end
54 secondary directional component of displacement of first distal end
60 displacement of second distal end
62 primary directional component of displacement of second distal end
64 secondary directional component of displacement of second distal end
$\theta_1$ closure arm leading surface angle
$\theta_2$ closure arm trailing surface angle
$\alpha_1$ primary closure element leading surface angle
$\alpha_2$ primary closure element trailing surface angle
$\alpha_3$ secondary closure element leading surface angle
$\alpha_4$ secondary closure element trailing surface angle
$\beta$ closure body arm angle
$H_1$ primary closure element height
$H_2$ secondary closure element height

The invention claimed is:

1. A hearing device comprising:
a housing;
a battery door attached to the housing to pivot in relation to the housing about a pivot axis; and
a closure member attached to the housing and having a first closure arm with a first distal end;
wherein the battery door comprises a closure device having a first primary closure element configured to engage with the first closure arm when the battery door is in a closed position; and
wherein the first closure arm is flexible such that the first distal end displaces in a first direction when the battery door is moved from an open position to the closed position, the first direction in which the first distal end displaces having a primary directional component parallel to the pivot axis.

2. The hearing device according to claim 1, wherein the first direction in which the first distal end displaces has a secondary directional component perpendicular to the pivot axis, the secondary directional component being smaller than the primary directional component.

3. The hearing device according to claim 1, wherein the closure member comprises a closure body with the first closure arm extending from the closure body.

4. The hearing device according to claim 3, wherein the closure body and the first closure arm forms an angle having a value anywhere from 90 to 170 degrees.

5. The hearing device according to claim 1, wherein the closure member is made of metal.

6. The hearing device according to claim 1, wherein the closure member is made of a plastic material.

7. The hearing device according to claim 1, wherein the housing comprises a dock for receiving the closure member and for connecting the closure member to the housing.

8. The hearing device according to claim 1, wherein the first closure arm comprises a first protrusion at the first distal end.

9. The hearing device according to claim 1, wherein the closure device comprises a first secondary closure element, wherein the first closure arm is configured to engage with the first secondary closure element when the battery door is in a semi-closed position.

10. The hearing device according to claim 1, wherein the closure member comprises a second closure arm with a second distal end, the closure device comprising a second primary closure element configured to engage with the second closure arm when the battery door is in the closed position; and wherein the second closure arm is flexible such that the second distal end displaces in a second direction when the battery door is moved from the open position to the closed position, the second direction in which the second distal end displaces having a primary directional component parallel to the pivot axis.

11. The hearing device according to claim 10, wherein the first direction and the second direction are opposite.

12. The hearing device according to claim 10, wherein the first closure arm and the second closure arm form an angle larger than 5 degrees.

13. The hearing device according to claim 10, wherein the second closure arm comprises a second protrusion at the second distal end.

14. The hearing device according to claim 10, wherein the closure device comprises a first secondary closure element a second secondary closure element;

wherein the first closure arm is configured to engage with the first secondary closure element when the battery door is in a semi-closed position; and wherein the second closure arm is configured to engage with the second secondary closure element when the battery door is in the semi-closed position.

15. The hearing device of claim 1, wherein the first distal end of the first closure arm has a protrusion that is configured to abut against the first primary closure element of the closure device at the battery door when the battery door is in the closed position.

16. The hearing device of claim 1, wherein the battery door is configured to hold a battery, and wherein the first distal end of the first closure arm is separated from the battery when the battery door is in the closed position.

17. A closure member for a hearing device comprising a closure body and a closure arm, the closure body and the closure arm forming an angle having a value that is anywhere from 90 to 170 degrees, wherein the closure arm has a distal end configured to abut against a component at a battery door of the hearing device when the battery door is in a closed position.

* * * * *